US006819888B2

(12) United States Patent
Teraoka et al.

(10) Patent No.: US 6,819,888 B2
(45) Date of Patent: Nov. 16, 2004

(54) LIQUID DEVELOPMENT APPARATUS AND IMAGE FORMATION APPARATUS

(75) Inventors: Tsutomu Teraoka, Tokyo (JP); Tsutomu Sasaki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/157,267

(22) Filed: May 30, 2002

(65) Prior Publication Data

US 2003/0016962 A1 Jan. 23, 2003

(30) Foreign Application Priority Data

May 30, 2001 (JP) ..... 2001-161749
Apr. 12, 2002 (JP) ..... 2002-111104

(51) Int. Cl.[7] ..... G03G 15/10
(52) U.S. Cl. ..... 399/57; 399/58
(58) Field of Search ..... 399/57, 58, 61, 399/237, 62

(56) References Cited

U.S. PATENT DOCUMENTS 5,642,188 A * 6/1997 Mochizuki et al. ..... 399/237
5,724,629 A * 3/1998 Iino et al. ..... 399/57
5,987,281 A * 11/1999 Kurotori et al. ..... 399/237
6,154,624 A 11/2000 Sasaki et al. ..... 399/250

FOREIGN PATENT DOCUMENTS

JP 2000-181148 6/2000
JP 2000-181149 6/2000

* cited by examiner

*Primary Examiner*—Hoan Tran
(74) *Attorney, Agent, or Firm*—Oblon, Spivak, McClelland, Maier & Neustadt, P.C.

(57) ABSTRACT

An attriter which applies a strong stress to a liquid developer, sufficient for generating the chemically non-equilibrium state therein, is parallel-connected with a developing unit, so that the stress is applied to a part of the liquid developer carried from a storage tank to a developing tank. However, in order to suppress crushing of the toner due to the application of excessive stress, the operation of the attriter is controlled in the following manner. That is, a charge quantity detection unit which detects the toner charge quantity of the liquid developer in the developing tank is provided, and based on the detection result thereof, the attriter is controlled.

17 Claims, 10 Drawing Sheets

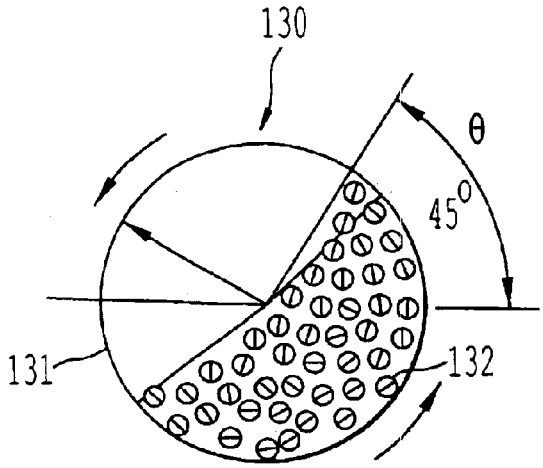
FIG. 10A
FIG. 10C
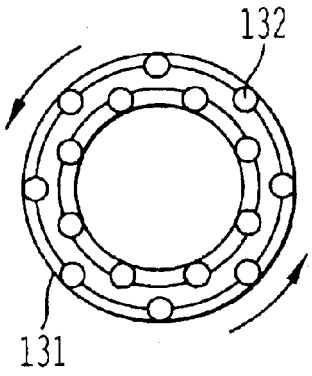
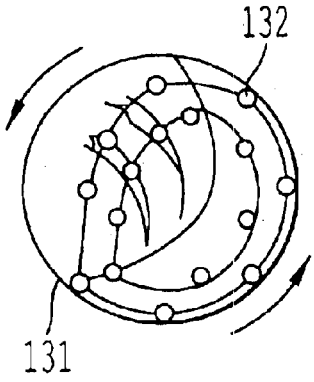
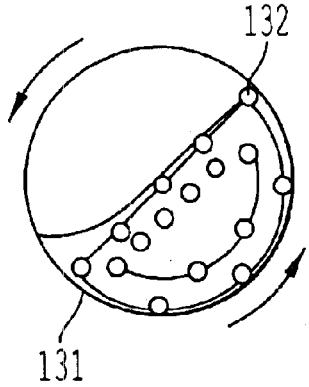
FIG. 10B
FIG. 10D

LIQUID DEVELOPMENT APPARATUS AND IMAGE FORMATION APPARATUS

FIELD OF THE INVENTION

The present invention relates to a liquid development apparatus which uses a liquid developer containing a toner in the liquid and an image formation apparatus using the same. More specifically, the present invention relates to a liquid development apparatus or the like which develops an electrostatic latent image formed by a method such as electrophotography, electrostatic recording or ionography.

BACKGROUND OF THE INVENTION

Conventionally, in an image formation apparatus which forms an image by using an electrophotographic method, there is one which develops an electrostatic latent image formed on a latent image supporting body by a liquid developer in which a toner is dispersed in a nonconductive liquid. With this type of image formation apparatus, the charge quantity of electric charge of the toner particles in an electric field easily changes between the initial stage and a stage after the lapse of time. In order to obtain a stable image having a little change in image quality, it is necessary to suppress a change in the charge quantity of the toner.

Therefore, various contrivances have been heretofore made for controlling the charge quantity in the liquid developer and the liquid developing process.

For example, as the one which exemplifies a liquid developer having excellent toner charging stability, redispersibility and charging stability at the time of redispersion, and capable of preservation for a long period of time and reuse, there can be mentioned Japanese Patent Application Laid-Open No. 2000-181148 and Japanese Patent Application Laid-Open No. 2000-181149. In these liquid developers, the composition is limited in order to exhibit desired charging stability and the like. However, there is an instance when a liquid developer comprising a different composition needs to be used, depending on the type of the liquid development apparatus.

As a method for stabilizing charging in the nonconductive liquid of the toner, there is known a method of monitoring the charge quantity and controlling the charge quantity by adding a charge control agent depending on the condition thereof. With this method, however, the mechanism becomes large and complicated because of installing a charge control agent replenishment mechanism. Further, a change with the lapse of time including a weight ratio of the charge control agent in the liquid developer has to be taken into account, causing a problem in that the construction for controlling the charge quantity becomes more complicated.

As a result of investigation relating to the cause of the change with the lapse of time of the charge quantity of the toner, the present inventors have found the followings. That is, the change with the lapse of time of the charge quantity includes an increasing case and a decreasing case, but the toner in the nonconductive liquid changes the electric charge to decrease frequently. In the liquid developer in which the toner is dispersed in the nonconductive liquid, the electric charge decreases with the lapse of time, as shown in FIG. 1. A and B in FIG. 1, there are shown toners having a difference in the formula of a coloring material and a resin material. It is seen that there is a difference in degree of the decreased amount of the electric charge according to the formula (toners A, B), but the decreased amount in both cases decreases with the lapse of time. In FIG. 1, the lapse of time is shown only for 20 days, but the decrease in the electric charge saturates about one month later. If the toner in the liquid developer coheres, a decrease in the electric charge of the toner can be seen, but in the toners A and B in the figure, cohesion does not occur. It is because, as shown in FIG. 2, any difference cannot be recognized in the particle size distribution of the toner between the initial stage and a stage after the lapse of time. For the reason why the electric charge of the toner decreases even though cohesion does not occur in the toner, the chemical state of the liquid developer is involved. Specifically speaking, when the degree of the chemically non-equilibrium state of the liquid developer increases, a deviation occurs in the polarity to increase the electric charge of the toner. On the other hand, when the liquid developer approaches the chemical equilibrium state, the electric charge of the toner decreases. With regard to the liquid developer in which the electric charge of the toner is decreased resulting from approaching to the equilibrium state, it is theoretically possible to return the electric charge of the toner to the original state by causing the chemically non-equilibrium state by applying an appropriate stress. However, it is necessary to increase the stress considerably. Specifically, in the conventional liquid development apparatus, a stirring member is provided for stirring the liquid developer, and a stress is given to the liquid developer by stirring. However, this stirring is performed for the purpose of making the toner density uniform in the liquid developer, and the stirring force is set to be weak which is sufficient for making the toner density uniform. With this level of stirring, it is difficult to sufficiently generate the chemically non-equilibrium state. The variation character of the electric charge of the toner shown in the figure shows a typical example, and the variation character thereof is not limited to the one shown in the figure. In the graph of FIG. 2, the ordinate on the left side from the dotted line in the figure is indicated by frequency (%), and the ordinate on the right side from the dotted line in the figure is indicated by accumulated total (%).

From this research result, people tend to jump to a conclusion that if the stress imparted to the toner (liquid developer) is increased than the conventional value, a decrease in the electric charge of the toner with the lapse of time can be dissolved. However, if the stress is increased, the toner is easily crushed by this. Also there is the possibility that the electric charge of the toner may be decreased by this crush. Further, not only the value (strength) of the stress, but also the stress application time take part in the crushing of the toner. With an increase of the stress, the toner is crushed with a shorter period of stress application time. Therefore, in order to increase the stress to the degree sufficient for generating the chemically non-equilibrium state, it is necessary to adequately control the stress application time, in addition to how much degree the stress applied to the liquid developer is increased.

However, it is very difficult to adequately control the stress application time with respect to the liquid developer in the apparatus. This is due to the reasons explained below. That is, in FIG. 1, the variation character of the electric charge of the toner in the liquid developer in which the toner is not replaced is shown, but in the actual apparatus, the toner often goes in and out with respect to the liquid developer. Specifically, the liquid development apparatus transports the liquid developer supported on a developing member such as a developing roller to a position opposite to a latent image supporting body to perform development of the latent image. Then, the liquid developer remaining on the developing member which has passed through the opposed position is collected and reused. The collected liquid developer has consumed the toner and the nonconductive liquid accompanying the development, and hence the toner density therein is changed from the initial state. Therefore, if the liquid developer is returned to the liquid developer in the apparatus, the toner density thereof will be changed. Therefore, the toner density of the liquid developer in the apparatus is monitored by a sensor, and a liquid developer and/or nonconductive liquid of high density is replenished into the apparatus, depending on the result, thereby the toner density in the liquid developer within the apparatus is stabilized. As described above, in the actual apparatus, the toner goes out from the liquid developer due to the toner consumption accompanying the development, or new toner comes into the liquid developer due to the replenishment of the liquid developer of high density. Since the electric charge as the whole toner in the liquid developer changes regardless of the lapse of time due to going in and out of the toner, the electric charge of the toner cannot be grasped based on the lapse of time. Hence, it is difficult to adequately control the stress application time.

In the Japanese Patent Application Laid-Open No. 2000-181148, there is disclosed an image formation apparatus provided with an attriter as a stress application unit which applies stress loading to the liquid developer. According to the experiments performed by the present inventors, this attriter could generate the chemically non-equilibrium state with respect to the liquid developer to thereby recover the electric charge of the toner. However, in this publication, the stress application time by the attriter is not taken into consideration. Therefore, there is the possibility that the toner may be crushed by the attriter, to thereby decrease the electric charge thereof.

SUMMARY OF THE INVENTION

It is an object of the present invention to provide a liquid development apparatus and an image formation apparatus which can reliably stabilize the charge quantity in a liquid developer, while preventing that the construction of the apparatus becomes complicated due to an attached charge control agent replenishment mechanism.

The present invention is a liquid development apparatus which has a developer storage section which stores a liquid developer containing a toner in the liquid, and a stress application unit which applies stress loading to the liquid developer in the developer storage section, and develops a latent image formed on a latent image supporting body in an image formation apparatus by the liquid developer, wherein a charge quantity detection unit which detects the toner charge quantity of the liquid developer in the developer storage section is provided.

The present invention is an image formation apparatus comprising a liquid development apparatus having a developer storage section which stores a liquid developer containing a toner in the liquid, and a stress application unit which applies stress loading to the liquid developer in the developer storage section, and a control unit which controls at least this liquid development apparatus, and develops a latent image on a latent image supporting body by the liquid development apparatus, wherein the control unit is constructed so as to control the operation of the stress application unit, based on the charge quantity change information showing the change of the toner charge quantity in the liquid developer in the developer storage section.

Other objects and features of this invention will become understood from the following description with reference to the accompanying drawings.

BRIEF DESCRIPTION OF THE DRAWINGS

FIG. 10A is a diagram which shows a ball mill, FIG. 10B is a diagram which shows the ball mill in the state that a ball is pressed so as to contact with the inner wall of the mill by high speed rotation, FIG. 10C is a diagram which shows the ball mill in which the ball is dropped like a waterfall in the mill by high speed rotation, and FIG. 10D is a diagram which shows the ball mill in which the ball is rolled in the mill by an appropriate rotation;

DETAILED DESCRIPTIONS

An embodiment of a printer, which is an image formation apparatus to which the present invention is applied will be explained in detail.

Figure 3:
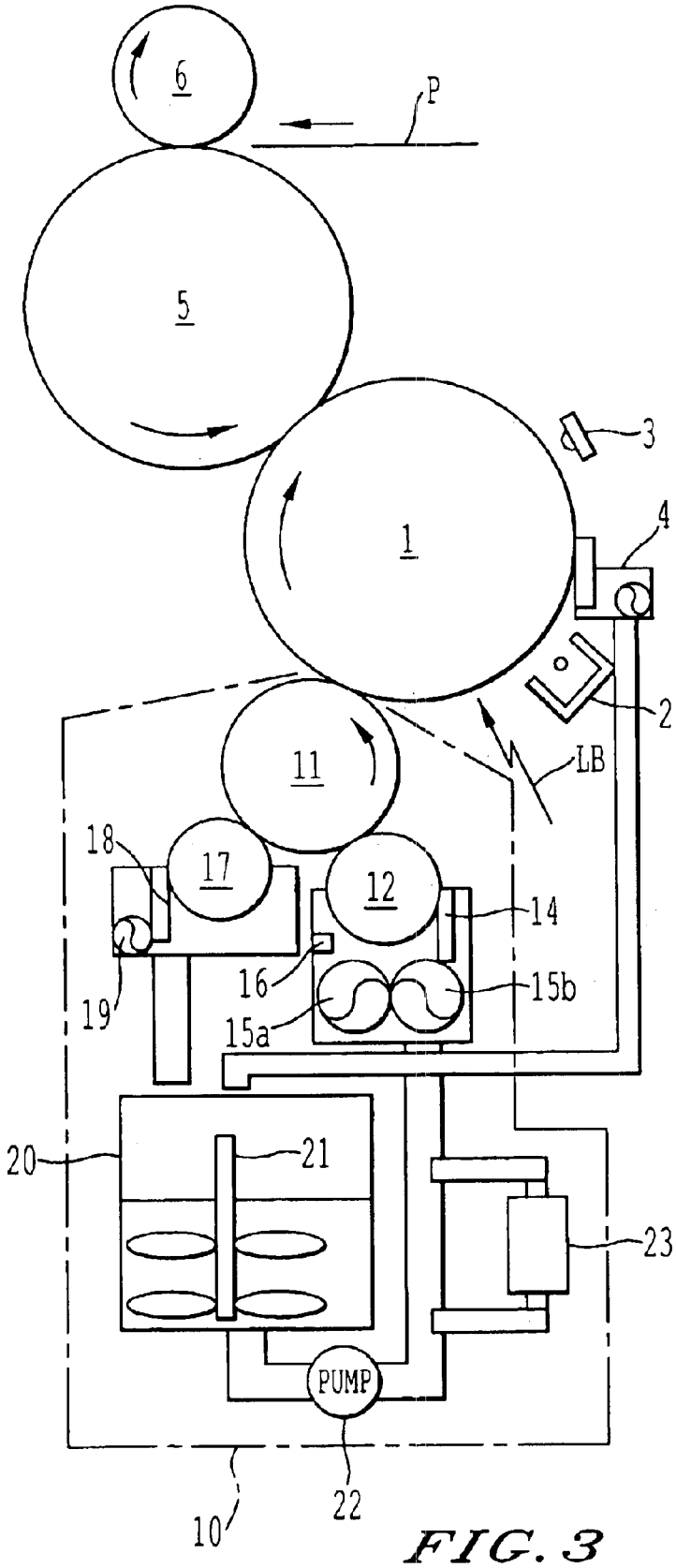
FIG. 3 is a major schematic configuration diagram of a printer according to one embodiment.

The basic construction of the printer according to this embodiment will be first explained. FIG. 3 is a major schematic configuration diagram of the printer according to the embodiment, wherein a charging unit 2, a developing unit 10, an intermediate transfer roller 5 and a drum cleaning unit 4 are arranged around a photosensitive material drum 1 as a latent image supporting body. An image formed on an intermediate transfer roller 5 is secondarily transferred onto a transfer paper P by a transfer bias roller 6 arranged opposite to the intermediate transfer roller 5.

The photosensitive material drum 1 is driven at the time of printing so as to rotate in the direction of an arrow at a certain speed by a drive unit such as a motor (not shown). After having been uniformly charged by the charging unit 2, the photosensitive material drum 1 is irradiated with a writing light LB and imaged based on the image information by an optical writing unit (not shown), so that an electrostatic latent image is formed on the photosensitive material drum 1. The electrostatic latent image is developed by the developing unit 10, and an image is formed on the photosensitive material drum 1. The image formed on the photosensitive material drum 1 is intermediately transferred onto the intermediate transfer roller 5 which is driven at the same speed as the photosensitive material drum 1. The transfer bias roller 6 is abutted against this intermediate transfer roller 5, and a transfer paper P is fed from a paper feed cassette (not shown) towards the both rollers. The image on the intermediate transfer roller 14 is secondarily transferred onto the transfer paper P carried to the space between the both rollers.

After the secondary transfer has been completed, the transfer paper P is sent to a fixing unit (not shown), and after the image has been fixed, the transfer paper P is ejected to outside the machine. The liquid developer on the photosensitive material drum 1 which has not been intermediately transferred onto the intermediate transfer roller 5 is removed from the photosensitive material drum 1 by the drum cleaning unit 4. The developer remaining after the transfer on the intermediate transfer roller 5 is removed by an intermediate transfer roller cleaning unit (not shown) Thereafter, the residual electric charge on the surface of the photosensitive material drum 1 is removed by a discharging lamp 3, for the next printing.

The developing unit 10 in the printer of this embodiment is mainly composed of a developing section, a developer collecting section and a developer adjusting section. As the liquid developer used in this embodiment, one having a viscosity of from 100 to 10000 mPa·s and a toner density of from 5 to 40% is used. More specifically, for example, a liquid developer having a viscosity of 300 mPa·s and a toner density of 15% is used.

The developing section has a developing roller 11 as a developing member, an application roller 12, a regulatory blade 13, a developing tank 14, a pair of screws 15*a* and 15*b*, and an electric characteristics evaluation mechanism 16. The developing tank 14 temporarily stores the liquid developer before being used for the development. The liquid developer is carried into the developing tank 14 from the developer adjusting section described later. The remainder of the liquid developer carried from the developer adjusting section overflows from a pipe (not shown) towards the developer collecting section described later, and collected from the developer collecting section to the developer adjusting section.

In the developing tank 14, a pair of screws 15*a*, 15*b* are driven to rotate, thereby the liquid level of the liquid developer therein rises, and the risen portion comes in contact with the application roller 12. By this contact, the liquid developer is supplied to the application roller 12. The liquid developer supplied to the application roller 12 is applied onto the developing roller 11, after the quantity of the liquid developer is restricted by the regulatory blade 13. The liquid developer is applied onto the developing roller 11 at a rate of about 30 cc/mim. The role of the electric characteristics evaluation mechanism 16 will be explained later.

The developer collecting section has a wiping roller 17, a cleaning blade 18 and a collection screw 19. The wiping roller 17 wipes off the liquid developer remaining on the surface of the developing roller 11 after the development. The wiped liquid developer is removed from the wiping roller 17 by the cleaning blade 18, and then collected to the developer adjusting section through the collection screw 19.

The developer adjusting section has a storage tank 20 which stores about 100 to 150 ml of the liquid developer, a stirring propeller 21, a carrier pump 22, a carrier pipe connected thereto, and an attriter 23 which is a redispersion mechanism parallel-connected thereto. The developer adjusting section also has a toner density detection unit (not shown). The stirring propeller 21, being a stirring member, stirs the liquid developer stored in the storage tank 20 to disperse the toner in the nonconductive solution, to thereby make the toner density in the liquid developer uniform. The toner density in the liquid developer within the storage tank 20 is detected by the toner density detection unit (not shown). On the other hand, this printer comprises a toner bottle (not shown), a carrier bottle, a toner make-up pump, a carrier make-up pump, and a control mechanism. In this toner bottle, the liquid developer to be replenished to the storage tank 20 is stored, and is replenished to the storage tank 20 by driving the toner make-up pump. In the carrier bottle, the nonconductive liquid to be replenished to the storage tank 20 is stored, and is replenished to the storage tank 20 by driving the carrier make-up pump. The printer control mechanism controls driving of the toner make-up pump and the carrier make-up pump based on the detection result of the toner density detection unit, to adjust the toner density in the liquid developer in the storage tank 20 to a predetermined range. The suction side of the carrier pump 22 in the developer adjusting section is connected to a drainpipe provided on the bottom of the storage tank 20, and the discharge side thereof is connected to the carrier pipe. The liquid developer in the storage tank 20 is carried to the developing tank 14 in the developing section. The attriter 23 parallel-connected to the carrier pipe, which is the route of this transport, takes in a part of the liquid developer during transport to redisperse the toner, and then returns it to the carrier pipe.

The characteristic construction of the printer will now be explained. In FIG. 3 shown above, the developing unit 20 has two developer storage sections. One is the storage tank 20 provided in the developer adjusting section, and the other is the developing tank 14 provided in the developing section. As described above, the liquid developer in the storage tank 20 is stirred by the stirring propeller 21, thereby stress loading is applied thereto. Therefore, the stirring propeller 21 has a function as the stress application unit which applies stress loading to the liquid developer. The liquid developer in the developing tank 14 is stirred by the pair of screws 15*a* and 15*b*, thereby stress loading is applied thereto. Therefore, the pair of screws 15*a* and 15*b* also has a function as the stress application unit. Though the liquid developer received in the developing unit 10, being the liquid development apparatus of the printer, is applied with stress by these stress application units, the toner charge quantity decreases with the lapse of time. Therefore, with these stress application units, the chemically non-equilibrium state cannot be generated in the liquid developer. Therefore, in this printer, there is provided in the developing unit 10 a third stress application unit which generates the chemically non-equilibrium state by applying a stress stronger than that applied by these stress application units to the liquid developer. This is the attriter 23 provided in the developer adjusting section of the developing unit 10.

Figure 4:
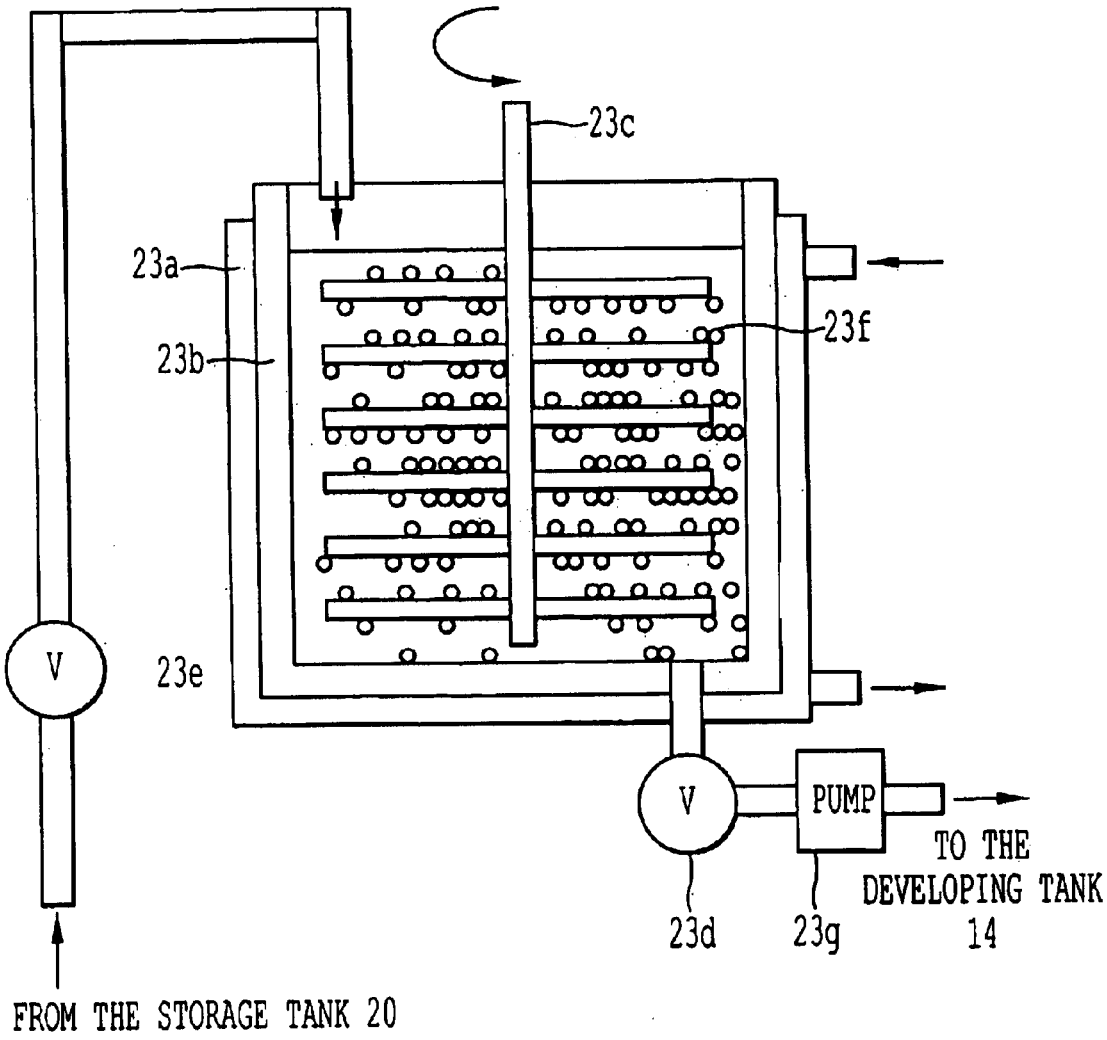
FIG. 4 is a diagram which shows the structure of an attriter.

This attriter 23 has a structure as shown in FIG. 4. That is, a tank 23*b* is housed in a jacket 23*a* which can return cooling water, and an agitator 23*c* which stirs the liquid developer is installed in the tank 23. A discharge valve 23*d* is installed to a pipe connected to the bottom of the tank 23*b*, and the outlet side of the discharge valve 23*d* is coupled to a pump 23*g* which can send the effluent to the developing tank 14. The liquid developer is fed to the tank 23*b* from the storage tank 20 (strictly speaking, the carrier pipe) in the developer adjusting section through a valve 23*e*. A plurality of beads is put into the tank 23*b*. The liquid developer fed from the storage tank 20 is stirred by the rotation of the agitator, together with the beads 23*f*. By this stirring, the liquid developer in the tank 23*b* generates heat, but the cooling water is returned into the jacket 23*a*, to thereby suppress an excessive temperature rise. In this printer, zirconia ceramic having a particle size of 1 mm is used as the beads 23*f*, and the filling rate thereof is made to be 70%. Then, an inflow pipe provided with the valve 23*c* and the discharge pipe provided with the pump 23*g* are respectively connected to the carrier pipe in the developer adjusting section.

In this printer, the attriter 23 shown in FIG. 4 is used as the stress application unit (redispersion mechanism) which recovers the toner charge quantity, but the present invention is not limited thereto. A mechanism capable of applying the stress loading which can generate the chemically non-equilibrium state in the liquid developer needs only be provided, and a disperser may be used. Other than this, for example, a ball mill, a beads mill or a sand mill can be used.

The present inventors carried out recoverability tests of the toner charge quantity by means of the attriter 23 shown in FIG. 4. For this recoverability tests, the electric characteristics test apparatus shown in FIG. 5 was used. In this figure, this electric characteristics test apparatus comprises a micrometer section 100, a high voltage generation apparatus 110 (manufactured by KEITHLEY Co., 237 type) and a personal computer 120. The micrometer section 100 has a first gold (Au) electrode 101 and a second gold electrode 102, respectively having a diameter of 1.7 cm, insulating materials 103 and 104 comprising Daifron or the like which covers the respective electrodes, and a micrometer 105. The first gold electrode 101 and the second gold electrode 102 face each other via a gap of 200 $\mu$m. In this gap, the liquid developer 106 is filled. A high voltage is applied to between the two gold electrodes (101, 102) by the high voltage generation apparatus 110. The current generated in the liquid developer 106 by the application thereof is detected by the micrometer 105 in the micrometer section 100, and the detection result is transmitted to the personal computer 120 as the current value data of a digital method. The personal computer 120 carries out various calculation processing based on the current value data transmitted from the micrometer 105.

Figure 6:
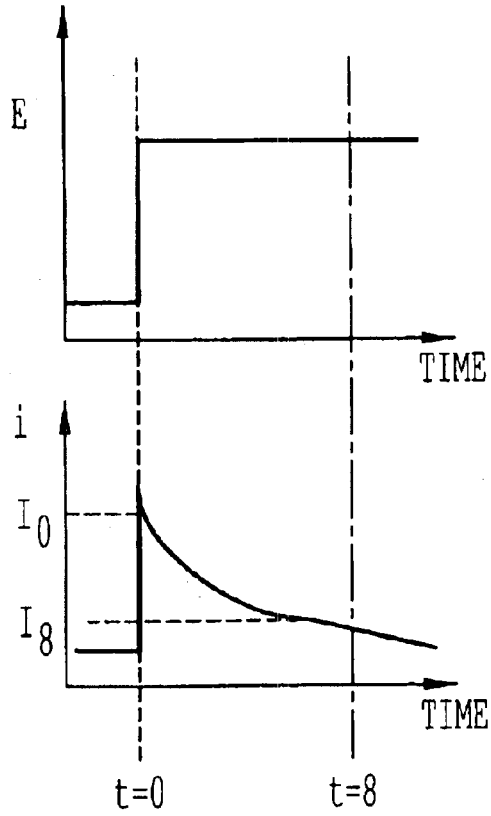
FIG. 6 is a diagram which shows a graph indicating a change with the lapse of time of an applied voltage in the electric characteristics test apparatus and a graph indicating a change with the lapse of time of a measured current value.

By using the electric characteristics test apparatus having the construction, the toner charge quantity in the liquid developer 106 was measured in the following manner. That is, a voltage of 100 V was applied to between the two gold electrodes (101, 102), and as shown in FIG. 6, the current values from the charging starting time (t=0) until 8 seconds had passed (t=8) were measured for each predetermined timing. Then, the initial current quantity 10 at the time of starting charging to the current quantity 18 after 8 seconds obtained after 8 seconds had passed, were integrated by the personal computer 120, to calculate the gross electric charge Q0 which had been consumed from starting charging until 8 seconds had passed. Then, based on the current value I8 after 8 seconds, steady-state electric charge Q8 which should be consumed during 8 seconds in the steady state was calculated. Then, the gross electric charge Qt of the whole toner particles was determined based on the relational equation shown by the following equation, $$Qt=Q_0-Q_8=Q_0-I_8\times 8 \text{ seconds.} \quad (1)$$

Figure 7:
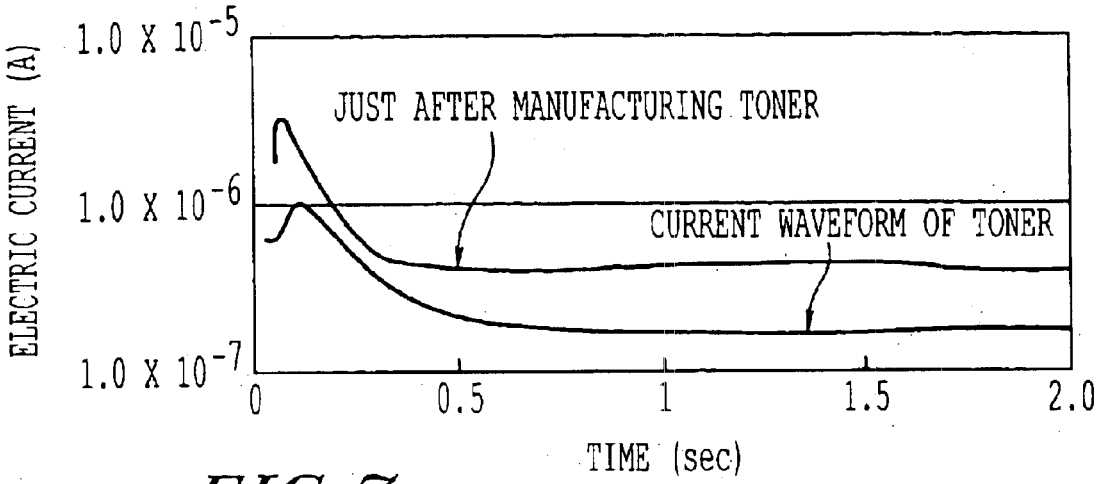
FIG. 7 sows a current waveform (a waveform by means of the initial developer and a waveform by means of the developer after the lapse of time without having redispersing operation) obtained by the electric characteristics test apparatus.
Figure 8:
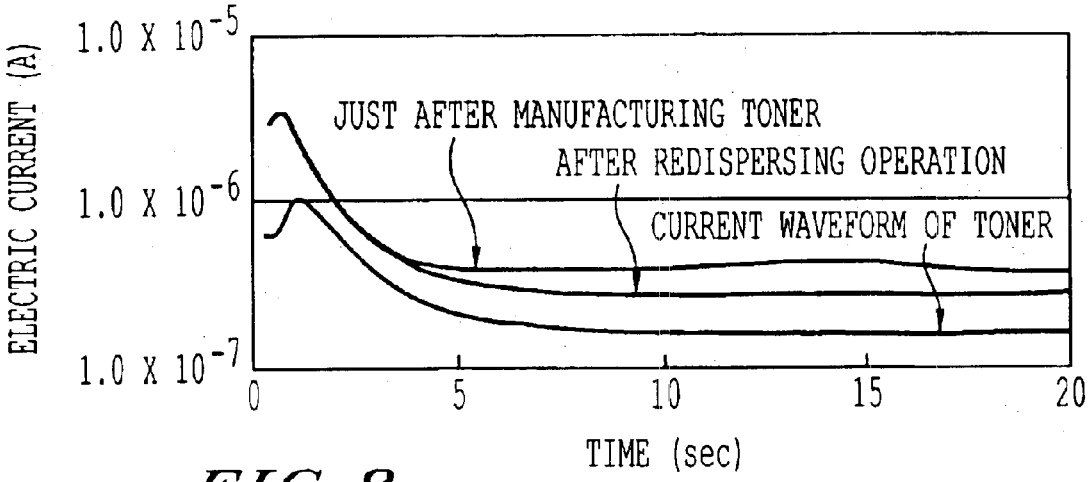
FIG. 8 is a graph obtained by overlapping a waveform of a redispersed developer on the waveform shown in FIG. 7.
Figure 9:
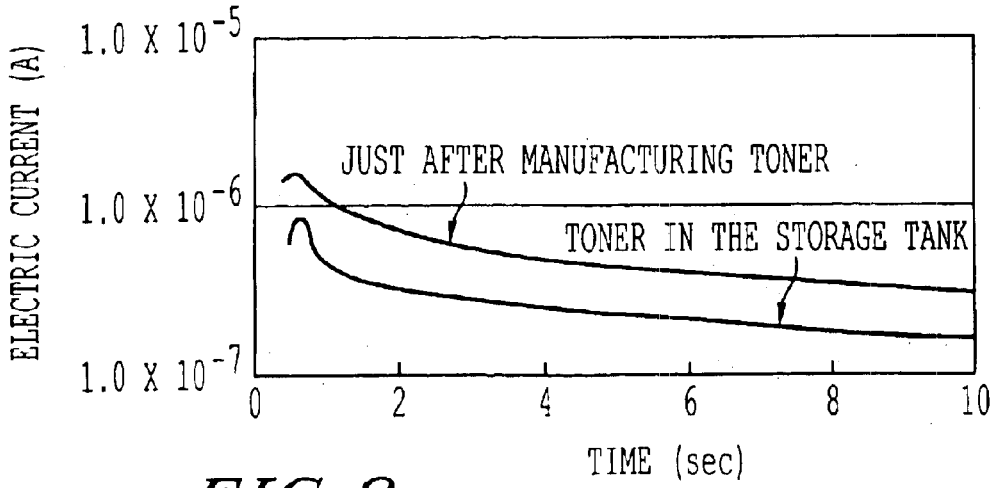
FIG. 9 is a graph which shows a current waveform in a liquid developer under the condition of not operating the attriter and a current waveform obtained by the initial developer.

A current waveform of a liquid developer just after preparation and a current waveform of the liquid developer one month later were obtained by using the electric characteristics test apparatus shown in FIG. 5. These are shown in FIG. 7. It is seen that the liquid developer one month later decreases the current value than that of the initial liquid developer. A decrease of the current value means that the toner charge quantity, being the integrated value thereof, is decreased. That is, the toner charging property decreases. The current waveform after the liquid developer in which the toner charging property decreased as described above had been subjected to the attriter 23 shown in FIG. 4 was overlapped on each current waveform shown in FIG. 7. The result is shown in FIG. 8. It is seen that the current waveform of the liquid developer after having passed the attriter 23 approaches the initial state. Though it is hard to see from the current waveform, the gross electric charge Qt is recovered nearly to the initial state. Therefore, it is possible to substantially return the toner charge quantity to the initial value. However, if the attriter 23 is not operated, there is a drop of current as shown in FIG. 9 only by stirring of the stirring propeller 21 and the screws 15*a* and 15*b*. Hence, it is understood that only with the stirring propeller 21 and the screws 15*a* and 15*b*, the toner charge quantity gradually decreases.

Figure 5:
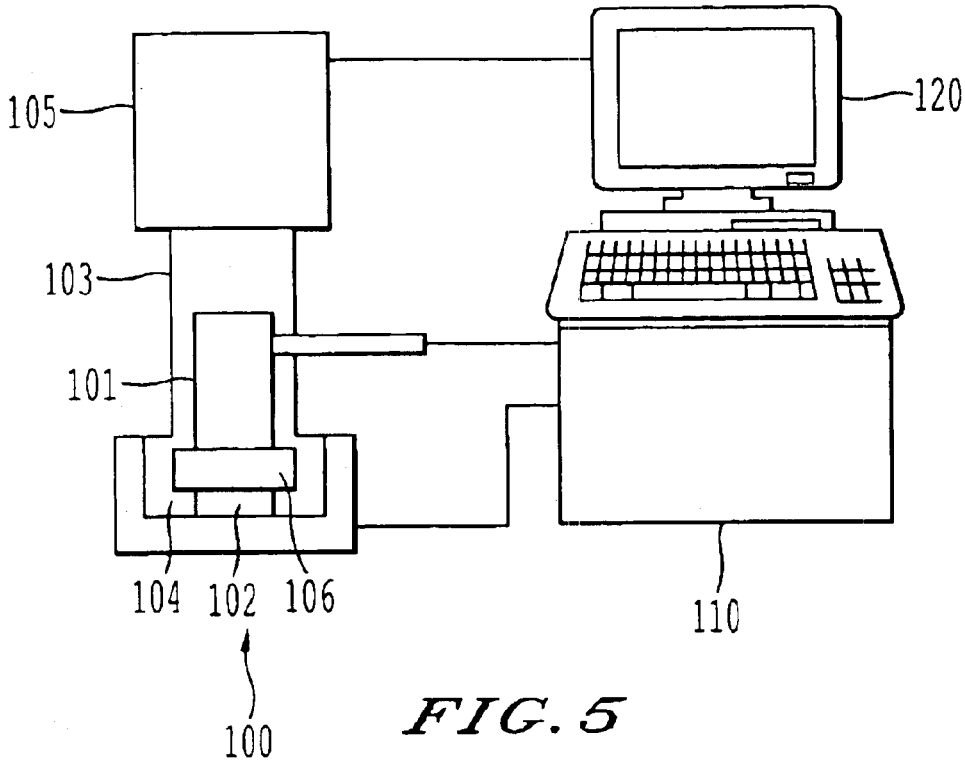
FIG. 5 is a diagram which shows an electric characteristics test apparatus used for a recoverability test of the toner charge quantity.

As for the evaluation of electric characteristics of the liquid developer, not only the electric characteristics test apparatus shown in FIG. 5, but also one capable of measuring the peak current characteristic of the moving liquid developer may be used. As for the electrode used for applying a voltage, one having a smaller electrode or a larger electrode may be used. One having a narrower or wider gap between electrodes may also be used without any problem. Further, a high voltage generation apparatus 10 of a smaller size may be used, or a small-size control mechanism constituted of a CPU or the like instead of the personal computer may be used. The electric characteristics evaluation mechanism 16 shown in FIG. 3 has two electrodes of the same size as that of the gold electrodes (101, 102) of the electric characteristics test apparatus shown in FIG. 5, arranged in the cell for support. On the printer body side, there are arranged a small-size high voltage generation apparatus, a control mechanism and an amperometric device (both not shown).

The recoverability test is performed with respect to the liquid developer which has passed through the attriter 23 shown in FIG. 4 only once, but if such a construction is employed that the attriter 23 is operated at all times, the toner may be crushed because of applying an excessive stress. "Operation at all times" referred to herein means operating the stress application member such as the agitator 23*c* (in the instance of the attriter in FIG. 4, the pump 23*g* in addition to the agitator 23*c*) at all times during the developing operation. Therefore, it is necessary to control the operation of the agitator 23 and the pump 23*g*, so that appropriate amount of stress is applied which does not change the physical properties such as the particle size of the toner or the like.

Therefore, the present inventors tested about the influence of the shear stress loading onto the toner particle size. The operation conditions of the attriter are as follows. That is, zirconia of 1 mm was filled therein up to 70%, and the agitator 23*c* was rotated at a peripheral speed of 1.0 m/sec. The toner particle size was measured using a Micro Track 2HRA type (manufactured by Nikkiso Co.). As a result of examination of the particle size distribution of the toner with respect to the liquid developer just after manufacturing and the liquid developer having been subjected to the attriter 23 for six hours, any difference was not recognized between the two liquid developers. However, if the liquid developer is subjected to the attriter 23 for more than 6 hours, or the peripheral speed of the agitator 23*c* is increased, the toner may be crushed. Basically, if a shear force larger than that of at the time of manufacturing is applied to the toner, the physical properties of the toner, such as particle size, change, thereby the electric characteristics also change largely. Hence, the stress at the time of manufacturing should not be exceeded. The influence of the redispersion mechanism such as the attriter 23 onto the particle size distribution of the toner depends on the operation conditions of the redispersion mechanism, and hence it is considered to be necessary to set the operation conditions appropriately.

The present inventors examined the relation between the shear stress and the crushability of the toner, using a ball mill which is the most generally used particle pulverizer, in order to study the appropriate setting of the operation conditions. As shown in FIG. 10A, this ball mill 130 stores a plurality of balls 132 in a cylindrical mill 131. Particles (not shown) to be dispersed are put into the mill 131. When the mill 131 is rotated after the particles have been put into the mill, the shear force due to rolling of the plurality of balls is applied to each particle, thereby the particles are gradually pulverized. If the rotation speed of the mill 131 is too high, as shown in FIG. 10B, the balls 132 are pressed against the inner peripheral face of the mill 131, and revolve together with the mill 131, or as shown in FIG. 10C, the balls 132 revolve half round, and then drop like a waterfall. With such a revolution or drop, the balls 132 do not roll well, and hence the crushability of the particles is poor. As shown in FIG. 10D, it is desirable that the rotation speed is such that the balls 132 lifted up slightly higher than the horizontal line roll down at a predetermined angle of inclination. The appropriate rotation speed of the mill 131 is mainly determined by the diameter of the mill 131. For example, the rotation speed is desirably about 21 rpm with the diameter of 1.6 m (full capacity of 2000 L), and about 18 rpm with the diameter of 1.8 m (full capacity of 3000 L). Since the shear stress can be given most effectively to the balls 132 rolling near the surface layer of the ball group, the balls 132 were put into the mill 131 up to the 30% capacity thereof in this test. As shown in FIG. 10A, the rotation speed was adjusted so as to roll the balls 132 near the surface layer at an angle of inclination θ of 45°. In this state, the space on the surface layer of the ball group becomes about 20%. The particles are dispersed in the liquid referred to as a mill base (in the liquid developer, the nonconductive liquid becomes the mill base). It is found that when the mill base is made to be about 20%, the best efficiency can be obtained. The size of the mill 131, the number of rotation, the capacity and size of the ball 132 and the composition and viscosity of the mill base affect largely on the crushability. A transparent glass mill was used as the mill 131, and the rotation speed was adjusted so that the angle of inclination θ became 45°. Zirconia balls having a diameter of 10 mm were used as the balls 132.

Figure 1:
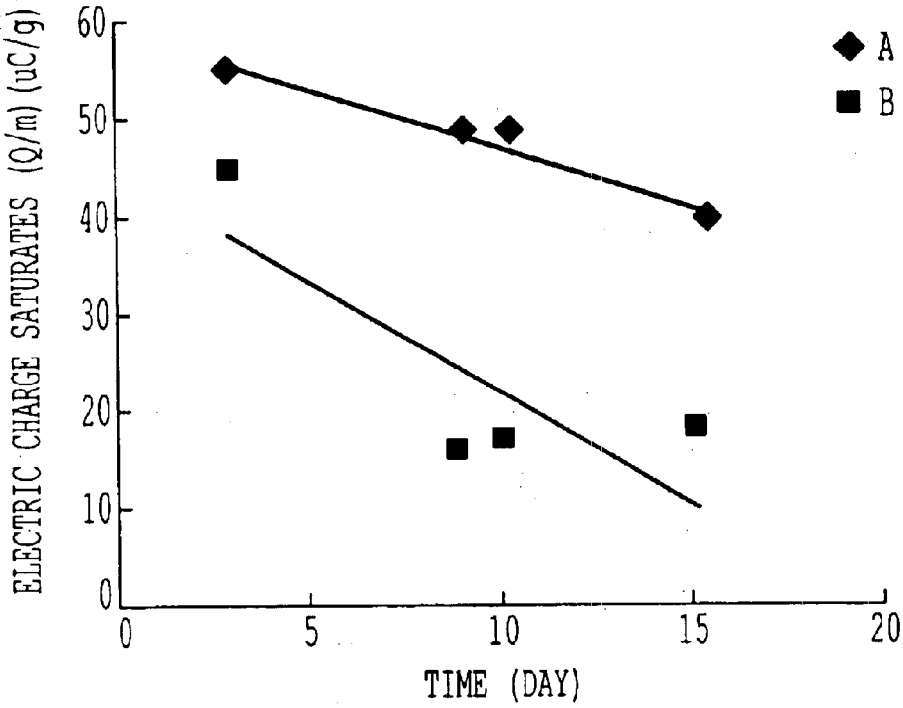
FIG. 1 is a graph which shows a change of the toner charge quantity with the lapse of time.
Figure 2:
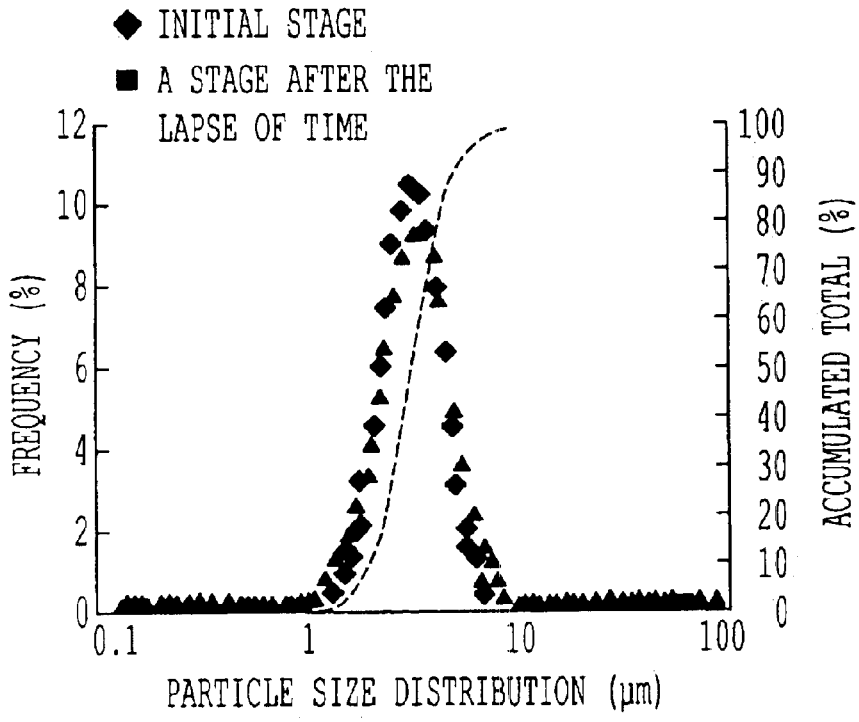
FIG. 2 is a graph which shows a particle size distribution of a toner in a liquid developer at the initial stage and a stage after the lapse of time.

Mills 131 having a diameter of 0.20 m were prepared to prepare a liquid developer, respectively. After the toner charge quantity was checked in the initial state just after preparation, the toner charge quantity was again measured after 1 month later. As a result, similar change with the lapse of time to that as shown in FIG. 1 could be recognized. Then, four mills 131 having a diameter of 0.05 m, 0.10 m, 0.20 m and 1.00 m were prepared, and the liquid developer after one month later was subjected to those mills for 24 hours under optimum conditions. With the mill 131 having a diameter of 1.00 m, the particle size of the toner was extremely smaller than that of the initial state, and the toner had physically different properties from the original toner. On the other hand, with the mills 131 having a diameter of 0.05 m, 0.10 m and 0.20 m, a big change could not be recognized in the particle size. From this result, it is proven that if the shear force given by the stress application member such as the agitator is excessive, the toner is crushed. With the mill 131 having a diameter of 0.05 m, the toner charge quantity could not be recovered.

It is desired to digitalize the shear force at the time of rolling the balls in the ball mill 130, but since the dispersion condition or the viscosity condition of the toner in the nonconductive liquid changes, it is difficult to digitalize it. Therefore, the collision speed v of the balls 132 in the mill 131 is determined by a general physical energy formula shown below, and is designated as a guideline to know the appropriate shear force, $$mgh=mv^2/2 \tag{2}$$

wherein, m is a mass, g is acceleration of gravity, and h is a height.

The relation between the ball fall velocity v in each mill, a change in the toner particle size and recoverability of the toner charge quantity is shown in Table 1 below.

TABLE 1

| Diameter of mill m | Collision speed v of balls m/sec | Change in toner particle size | Recovery of toner charge quantity |
|---|---|---|---|
| 0.05 | 0.83 | No | No |
| 0.10 | 1.18 | No | Yes |
| 0.20 | 1.66 | No | Yes |
| 1.00 | 3.72 | Decrease | — |

From Table 1, it is considered to be necessary to make the stress application member such as the agitator 23*c* collide with the liquid developer at a speed of 1 m/sec or higher, in order to recover the toner charge quantity. In this printer, as described above, the agitator 23*c* is rotated at a peripheral speed of 1.0 m/sec, and under this condition, the toner charge quantity has been recovered. Therefore, it can be said that a collision speed of the stress application member should be at least 1.0 m/sec.

When the liquid developer is subjected to the ball mill 130 for several days, there is the possibility that the toner is crushed even in a mill having a diameter less than 1.00 m. Therefore, with regard to the redispersion mechanism such as the attriter 23, it is necessary to appropriately control the operation speed of the stress application member as well as the operation time thereof.

In this printer, there is provided a charge quantity detection unit constituted by the electric characteristics evaluation mechanism 16 shown in FIG. 3, and unillustrated high voltage generation apparatus, control mechanism and amperometric device or the like. This charge quantity detection unit has a function similar to that of the electric characteristics measuring apparatus shown in FIG. 5, and can detect the toner charge quantity in the liquid developer in the developing tank 14 shown in FIG. 3. The control mechanism of the charge quantity detection unit also serves as the control mechanism of the printer body, and controls the operation of the attriter 23 in accordance with the detection result of the toner charge quantity. More specifically, the control mechanism as the control unit operates the attriter 23 when the gross electric charge Qt falls below a predetermined reference value, to thereby recover the toner charge quantity. When the gross electric charge Qt is recovered up to the reference value, the control mechanism stops the attriter 23, to suppress the pulverization of the toner. By the combination of such a charge quantity detection unit and the attriter 23, it becomes possible to stably control the toner charge quantity.

An electric field is applied to the liquid developer collected from the developing roller 11 and the photosensitive material drum 1 shown in FIG. 3, and slight cohesion can be seen. However, when the liquid developer is returned to the storage tank 20 in the developer adjusting section and a sufficient amount of nonconductive liquid is replenished thereto and stirred, this level of cohesion is dissolved immediately.

Figure 11:
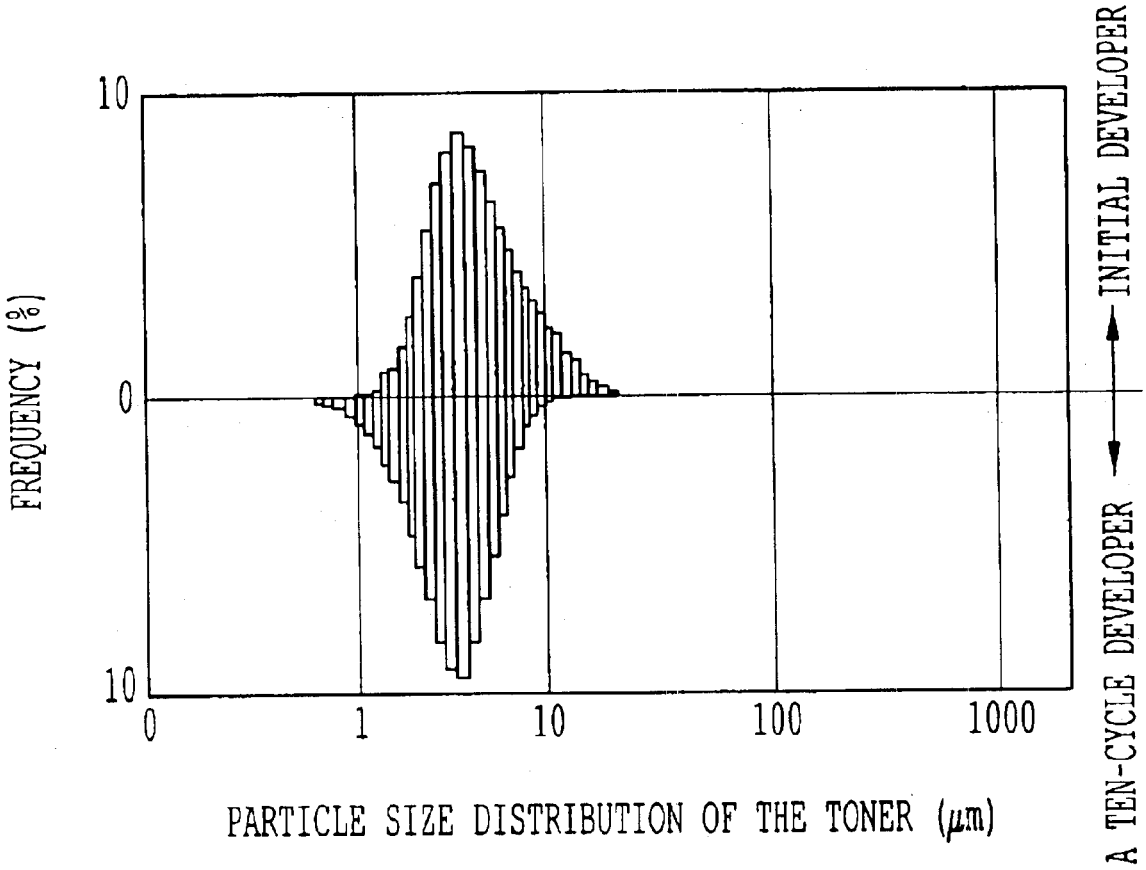
FIG. 11 is a graph which shows the particle size distribution of the toner in the initial developer and the particle size distribution of the toner in a ten-cycle developer.

The present inventors have confirmed that in the printer, even the liquid developer after the application of the electric field recovers the toner charge quantity by the attriter 23. The present inventors have also carried out a cycle test of the liquid developer as explained below, in order to study the effect of suppressing the pulverization of the toner in the printer, by controlling the operation of the attriter 23 based on the toner charge quantity described above. That is, the period while the liquid developer for the capacity of the storage tank (100 to 150 ml) is transported from the storage tank 20 to the developing tank 14 is designated as one cycle. After printing operation had been performed until 10 cycles of the developer transport were carried out, the liquid developer in the storage tank 20 was collected as a developer for 10 cycles. Prior to this, the liquid developer in the initial state before the cycle was collected from the storage tank 20, which was designated as an initial developer. The particle size distribution in the toner in these liquid developers was measured by using the Micro Track 2HRA type (manufactured by Nikkiso Co.). The result thereof is shown in FIG. 11. It is seen that even if printing operation is carried out in which the liquid developer is transported for 10 cycles, the particle size of the toner in the liquid developer in the storage tank 20 is not changed.

Figure 12:
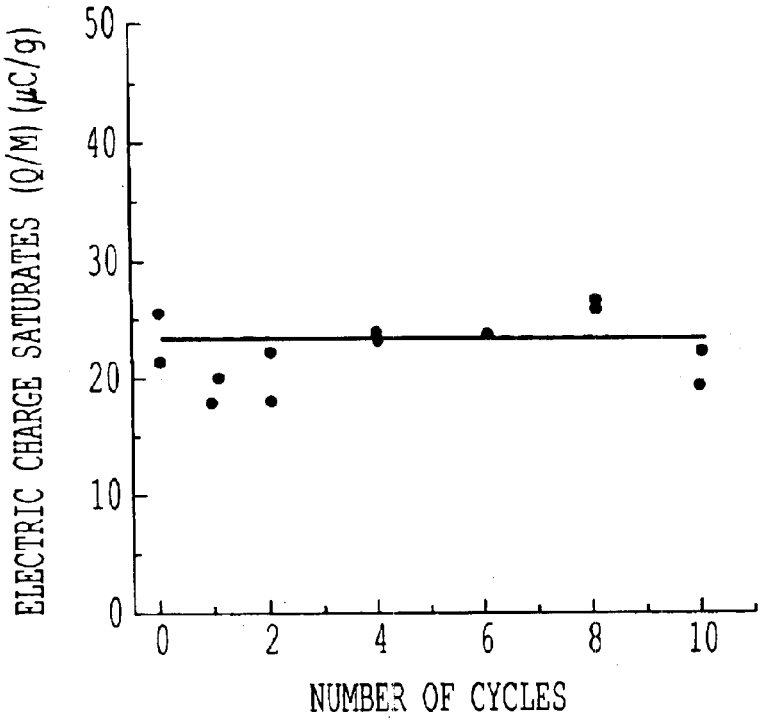
FIG. 12 is a graph which shows the relation between the number of cycles and the toner charge quantity.

FIG. 12 is a graph which shows the relation between the number of cycles of the liquid developer and the toner charge quantity. As shown in the figure, in this printer, the toner charge quantity is maintained to about 25 $\mu$C/g from the initial state up to 10 cycles. From this figure, it is seen that in this printer, the toner charge quantity can be favorably recovered, while suppressing the pulverization of the toner due to excessive stress loading by the attriter 23. When the drive of the attriter 23 is stopped, the toner charge quantity decreases with the lapse of time as shown in FIG. 1, and drops to about ½ after two weeks later. From the examination result of the ball mill and the result by the actual printer, it is seen that an adequate stress exists.

In this printer, the attriter 23 is arranged parallel to the carrier pipe to form parallel channels, but the attriter 23 may be built in the carrier pipe, so that the agitator 23*c* is appropriately driven as required. Alternatively, the attriter 23 may be built in the developing tank 14 of the developing unit 10. Simple constructions may be obtained by these arrangements. Further, balls may be used instead of the beads 23*f*. In addition, a Peltier element or an air-cooling fin may be used instead of the water-cooling jacket 23*a*. If the redispersion mechanism such as the attriter is provided in the carrier pipe, not in the storage tank 20 or in the developing tank 14, the toner charge quantity of the liquid developer in the developing section can be stabilized at all times. Further, the structure of the apparatus can be simplified rather than the redispersion mechanism is installed in the developing tank 14 where various parts such as the developing roller 11 are close-set. Even if a new liquid developer is added and used at the time of starting the next printing, since the toner charge quantity is controlled before reaching the developing tank 14, the image quality such as the image density and hue can be stabilized. However, it is necessary to control the redispersion mechanism based on the detection result of the charge quantity detection unit. For example, when the attriter 23 is built in the carrier pipe, the liquid developer is transported in the state that the agitator 23*c* is suspended, so that the pulverization of the toner is not accelerated by operating the agitator 23*c* over and above what is wanted.

Figure 13:
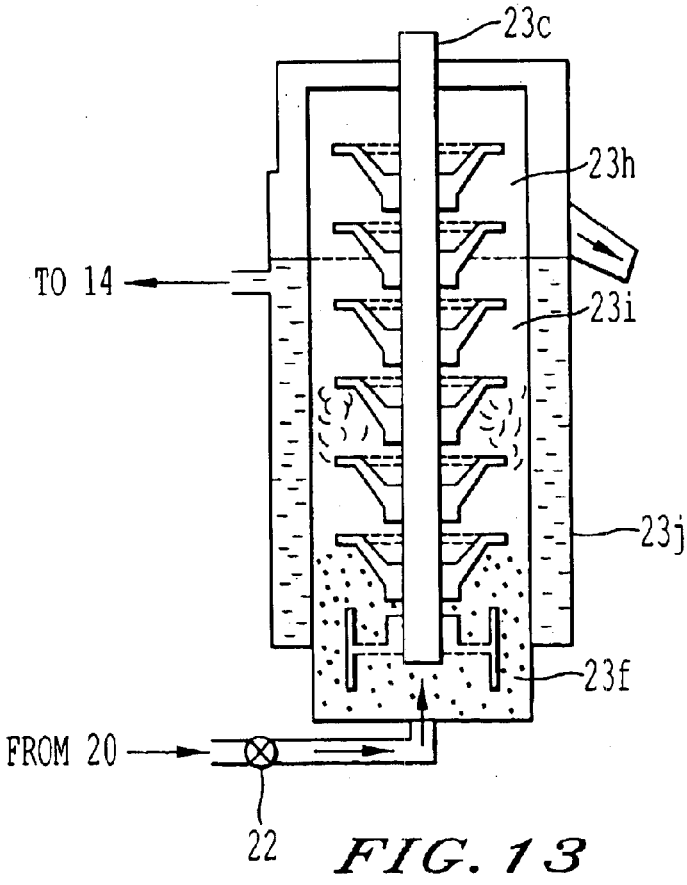
FIG. 13 is a configuration diagram which shows an example in which an attriter function is added to a carrier pipe.

FIG. 13 shows an example in which an attriter function is added to the carrier pipe. This carrier pipe has a double structure including an inner tube 23*i* in an outer tube 23*j*. The liquid developer transported from the storage tank 20 in the developer adjusting section by the carrier pump 22 goes into the inner tube 23*i*, and carried while being stirred by the agitator 23*c* together with the beads 23*f*. The vicinity of the end of the inner tube 23*i* is a mesh screen 23*h*, where the liquid developer is separated from the beads 23*f*, and carried to the space between the inner tube 23*i* and the outer tube 23*j*. Then, the liquid developer passes through an exhaust passage provided in the outer tube 23*j*, and carried to the developing tank 14 in the developing section.

In this printer, if it is assumed that cohesion of the toner with the lapse of time or cohesion of the toner due to application of an electric field accompanying development occurs to a level that cannot be dissolved by stirring of the stirring propeller 21 and the screws 15*a* and 15*b*, then, even if such cohesion occurs, the cohered toner can be refined to the same level as the particle size of the toner before use by the attriter 23, and after being refined, substantially the same charge quantity can be maintained as that of before use. Further, the excess portion of the liquid developer used in the development can be collected, and redispersed by the attriter 23, and then returned to the storage tank 20 to be combined with the unused liquid developer. Further, the used liquid developer can be collected, returned to the storage tank 20 and combined with the unused liquid developer, and then redispersed. Even if such cyclic usage is performed, stable image quality can be obtained.

As the nonconductive liquid used in this printer, one exhibiting a thermally high flash point and an electrically high resistance is desirable. One exhibiting a viscosity of from 0.5 to 1000 mPa·s is further desirable. This is due to the following reasons. That is, the liquid developer is formed in a thin layer on the developing roller 11, and this layered liquid developer passes through the photosensitive material drum 1 and the intermediate transfer roller 5 and adheres on the transfer paper P. In this process, a part of the nonconductive liquid remains on the photosensitive material drum 1 and the intermediate transfer roller 5, and hence the amount of the nonconductive liquid reaching the transfer paper P is very small. However, though small, if the nonconductive liquid remains on the surface of the transfer paper P, there is the possibility that stains on the transfer paper P or disorder of the image may be caused due to the adhesion of dust or the like. If the nonconductive liquid is one having a relatively low viscosity, these stain and disorder of the image can be suppressed, since these can be absorbed inside the paper fiber. According to the research made by the present inventors, if one having a viscosity of not larger than 1000 mPa·s is used as the nonconductive liquid, stain or the like resulting from the residual nonconductive liquid on the surface is absorbed inside the paper fiber and does not appear on the transfer paper P after fixation. However, if one having a viscosity of less than 0.5 mPa·s is used as the nonconductive liquid, it is handled as a hazardous substance due to the high volatility, and usage by general users becomes difficult, and hence this nonconductive liquid is not suitable. Therefore, as the nonconductive liquid, it is desired to use one having a viscosity of from 0.5 to 1000 mPa·s.

As the nonconductive liquid, it is also desirable to use one having a boiling point of not lower than 100° C. If the boiling point is lower than 100° C., the volatility is generally high, and there is a problem in the storing method of the liquid developer. Further, in addition to make the printer body have a sealed structure, it is necessary to make the printer installation environment special.

As the nonconductive liquid, it is also desirable to use one having an electrical resistance of $1\times10^{12}$ Ωcm or less. If the electrical resistance exceeds this level, an electric current leaks to between the toners due to an insufficient insulation resistance, and hence the construction of the liquid developer for developing an electrostatic latent image becomes difficult. The nonconductive liquid having an electrical resistance of $1\times10^{12}$ Ωcm or less includes silicone oil, normal paraffin, isopar, vegetable oil, mineral oil and the like. Among these, silicone oil is preferable. Silicone oil is nonvolatile, and does not adhere in the attriter 23. Hence, it does not give bad influence to the work environment, and a maintenance mechanism for the redispersion mechanism is not necessary.

As the nonconductive liquid, it is also desirable to use one having a surface tension of not larger than 30 dyne/cm. If the surface tension exceeds this level, the wettability of the toner is rapidly deteriorated, to make the toner mass adhere on the photosensitive material drum to cause deterioration in the image quality, such as greasing.

As for the liquid developer containing the nonconductive liquid, it is desired to adjust the application thickness (thickness of the thin layer) on the developing roller 11, depending on the viscosity thereof. Particularly, for one having a viscosity of 500 mPa·s or higher, it is necessary to make the application thickness very thin. Ideally, it is preferable to make it slightly thinner than the thickness including the toner quantity required at the time of development (quantity that can develop a solid portion to a saturation density). This is because if a liquid developer having a high viscosity is used, when the toner moves electrostatically towards the electrostatic latent image at the time of development, excessive toner is brought together due to the viscosity and adheres on the photosensitive material drum 1. According to the research made by the present inventors, with a thickness of from 5 to 40 μm, favorable image can be obtained.

As the toner, it is desired to use one having an average particle size of from 0.1 to 5 μm. It is because the toner exists as a mass of 5 to 10 pieces on the printed paper, and if the average particle size exceeds 5 μm, high resolution development becomes difficult. If the average particle size is less than 0.1 μm, physical adhesive power becomes strong, and it becomes difficult to transfer the toner at the time of transfer, deteriorating the transfer efficiency rapidly.

As the liquid developer, it is desired to use one containing the toner at a density of from 5 to 40%. If the toner density is less than 5%, the toner quickly precipitates in the nonconductive liquid to deteriorate the dispersibility rapidly. On the other hand, if the toner density exceeds 40%, the toner cannot exhibit the property as a "liquid" due to the poor fluidity.

It is desired that the liquid developer contain a charge control agent to control the charge quantity of copolymer resin particles, being the toner particles, and/or the charging polarity. This is due to the reason explained below. That is, as described above, in the nonconductive liquid, if the nonconductive liquid is in the chemically non-equilibrium state, a deviation occurs in the polarity, to increase the toner charge quantity. Therefore, if a charge control agent is added, as one assisting the charging in the nonconductive liquid, the adsorption state of the charge control agent with respect to the toner is changed due to a stress by means of stirring or redispersion. Thereby, the chemically non-equilibrium state can be generated more reliably. Therefore, in order to perform such charge control, a liquid developer having a charge control agent added in the composition is preferable.

As the charge control agent, there can be used known materials such as a charge director which generates an electrostatic charge in the dispersed toner particles and reinforce the toner particles. Such materials include metallic soaps, fatty acids, lectin, organic phosphorus compounds, succinimides and sulfosuccinates. For example, metal salts such as cobalt dialkyl sulfosuccinate, manganese dialkyl sulfosuccinate, zirconium dialkyl sulfosuccinate, yttrium dialkyl sulfosuccinate, and nickel dialkyl sulfosuccinate may be used. Further, metallic soaps such as manganese naphthenate, calcium naphthenate, zirconium naphthenate, cobalt naphthenate, iron naphthenate, lead naphthenate, nickel naphthenate, chromium naphthenate, zinc naphthenate, magnesium naphthenate, manganese octylate, calcium octylate, zirconium octylate, iron octylate, lead octylate, cobalt octylate, chromium octylate, zinc octylate, magnesium octylate, manganese dodecylate, calcium dodecylate, zirconium dodecylate, iron dodecylate, lead dodecylate, cobalt dodecylate, chromium dodecylate, zinc dodecylate, and magnesium dodecylate may be used. Alternatively, metal salts of alkylbenzenesulfonate such as calcium dodecylbenzenesulfonate, sodium dodecylbenzenesulfonate, and barium dodecylbenzenesulfonate may be sued. Phosphorous lipids such as lecithin and cephalin, or organic amines such as n-decylamine maybe used. However, the charge control agent is not limited to the one shown here.

The amount of the charge control agent to be added may be the lowest amount exhibiting the charge control effect, and generally, the charge control agent is added in the liquid developer in an amount of from 0.01 to 50% by weight. The charge control agent exhibits the charge control effect by being added in either stage of the production process described later or after the solvent has been removed, but preferably, granulation is carried out under coexistence of the charge control agent. For example, in the granulation process of the toner, the charge control agent is added in other materials, the solvent or an intermediate product at a stage before the granulation process, and a copolymer resin solution or varnish and an insulating dispersion medium are mixed under coexistence of a coloring agent and the charge control agent.

Taking the properties of these preferable liquid developers into consideration, a liquid developer which satisfies the conditions listed below is used in this printer, (1) to contain silicone oil having a viscosity of from 0.5 to 1000 mPa·s, an electrical resistance of at least $1\times10^{12}$ Ωm, a surface tension of not larger than 30 dyne/cm, and a boiling point of not lower than 100° C., as the nonconductive liquid, (2) to contain a toner having an average particle size of from 0.1 to 5 μm in a density of from 5 to 40%, and (3) to contain zirconium octylate in an amount of 0.5% by weight as the charge control agent.

It is specified to use one that satisfies these conditions as the liquid developer, with respect to users who use this printer. Such specification may be given by shipping the printer together with the liquid developer packed together, or by adding a sentence indicating to use one satisfying the conditions on the printer body or in the instruction manual. Alternatively, this matter may be notified to the user by a written notice or by electronic data.

Figure 14:
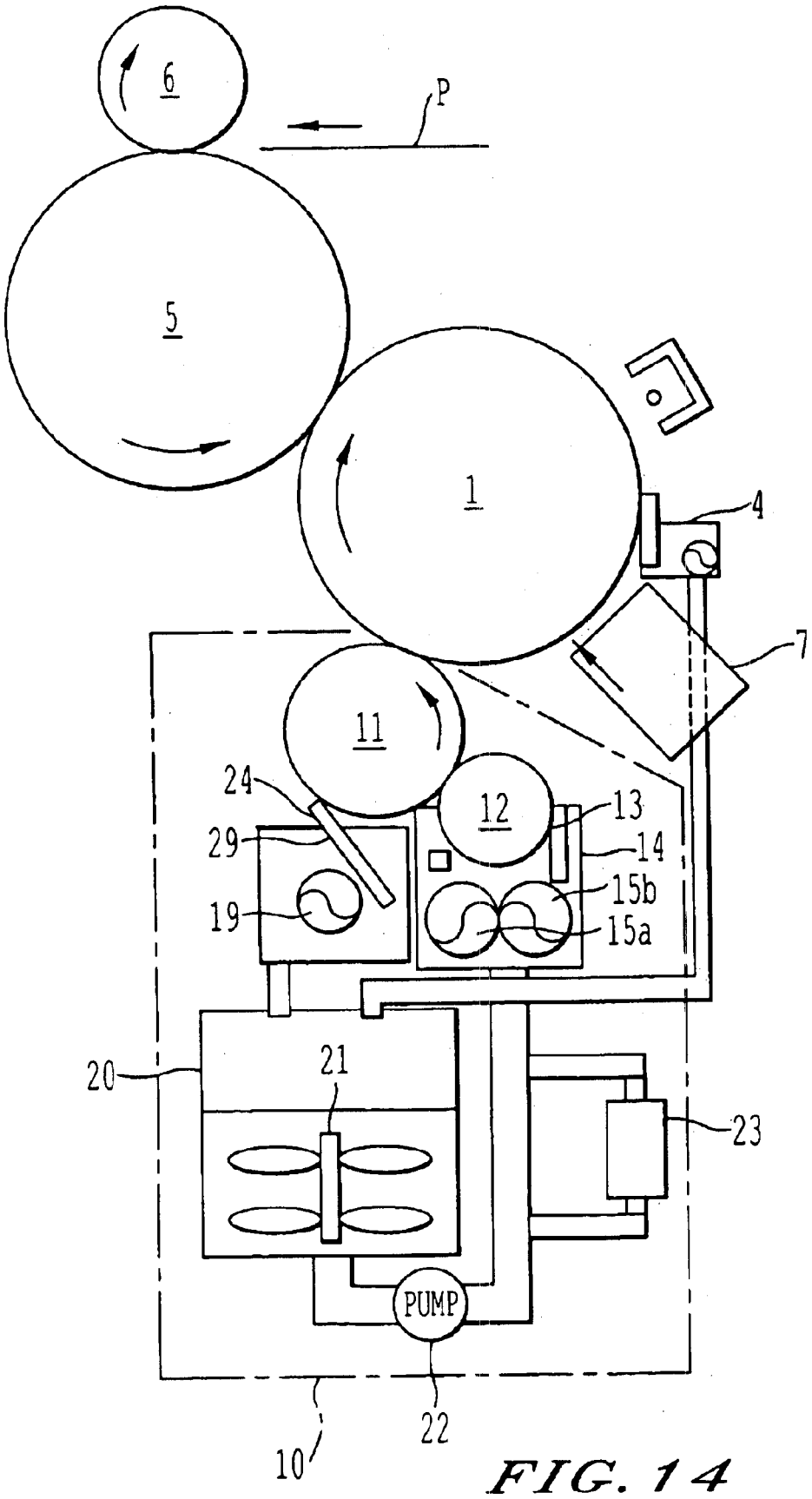
FIG. 14 is a major schematic configuration diagram of an apparatus of a modified example which adopts an ionographic method.

As the image formation apparatus to which the present invention is applied, not only the electrographic printer shown in FIG. 3, but also an ionographic printer may be used. FIG. 14 is a major schematic configuration diagram of an apparatus of a modified example which adopts the ionographic method. In this figure, there are arranged an ion flow head 7, a developing unit 10, an intermediate transfer roller 5, and a drum cleaning unit 4 around a latent image supporting drum 1. An image formed on the intermediate transfer roller 5 is secondarily transferred onto a transfer paper P by a transfer roller 6 arranged opposite to the intermediate transfer roller 5. The latent image supporting drum 1 is driven at the time of printing so as to rotate in the direction of an arrow at a certain speed by a drive unit such as a motor (not shown). Ion is irradiated to the latent image supporting drum 1 by the ion flow head 7, based on the image information, thereby the electrostatic latent image is formed on the latent image supporting drum 1. This electrostatic latent image is developed by the developing unit 10, and the image is formed on the latent image supporting drum 1. The image formed on the latent image supporting drum 1 is intermediately transferred onto the intermediate transfer roller 5 which is driven at the same speed as that of the drum. The image on the intermediate transfer roller 5 is secondarily transferred onto the transfer paper P carried to a transfer section from a paper feed cassette (not shown). After the secondary transfer has been completed, the transfer paper P is fixed by a fixing unit (not shown) and ejected. The liquid developer on the latent image supporting drum 1 that has not been intermediately transferred onto the intermediate transfer roller 5 is removed from the drum 1 by the drum cleaning unit 4. The developer remaining after the transfer onto the intermediate transfer roller 5 is removed by an intermediate transfer roller cleaning unit (not shown). Thereafter, the residual electric charge on the surface of the latent image supporting drum 1 is removed by a discharging lamp (not shown), for the next printing.

The developing unit 10 in the apparatus of this modified example comprises the same developing section, developer collecting section and a developer adjusting section as those of shown in FIG. 3. This developing unit 10 uses a liquid developer which satisfied the conditions.

In the developing section, there are provided a developing tank 14 which stores a liquid developer, an application roller 12 which applies the liquid developer on the developing roller 11, and a pair of screws 15*a* and 15*b* which supply the liquid developer to the application roller 12. A regulatory blade 13 which regulates the amount of the liquid developer on the surface of the application roller 12 is also arranged. The storage tank 24 can store the liquid developer of from 100 to 150 ccml. The operation of the developing unit 10 is the same as that of the one shown in FIG. 3.

As the image formation apparatus to which the present invention is applied, there can be used one which forms a monochrome image shown in FIG. 3 and FIG. 14, as well as one which forms a multicolor image.

Figure 15:
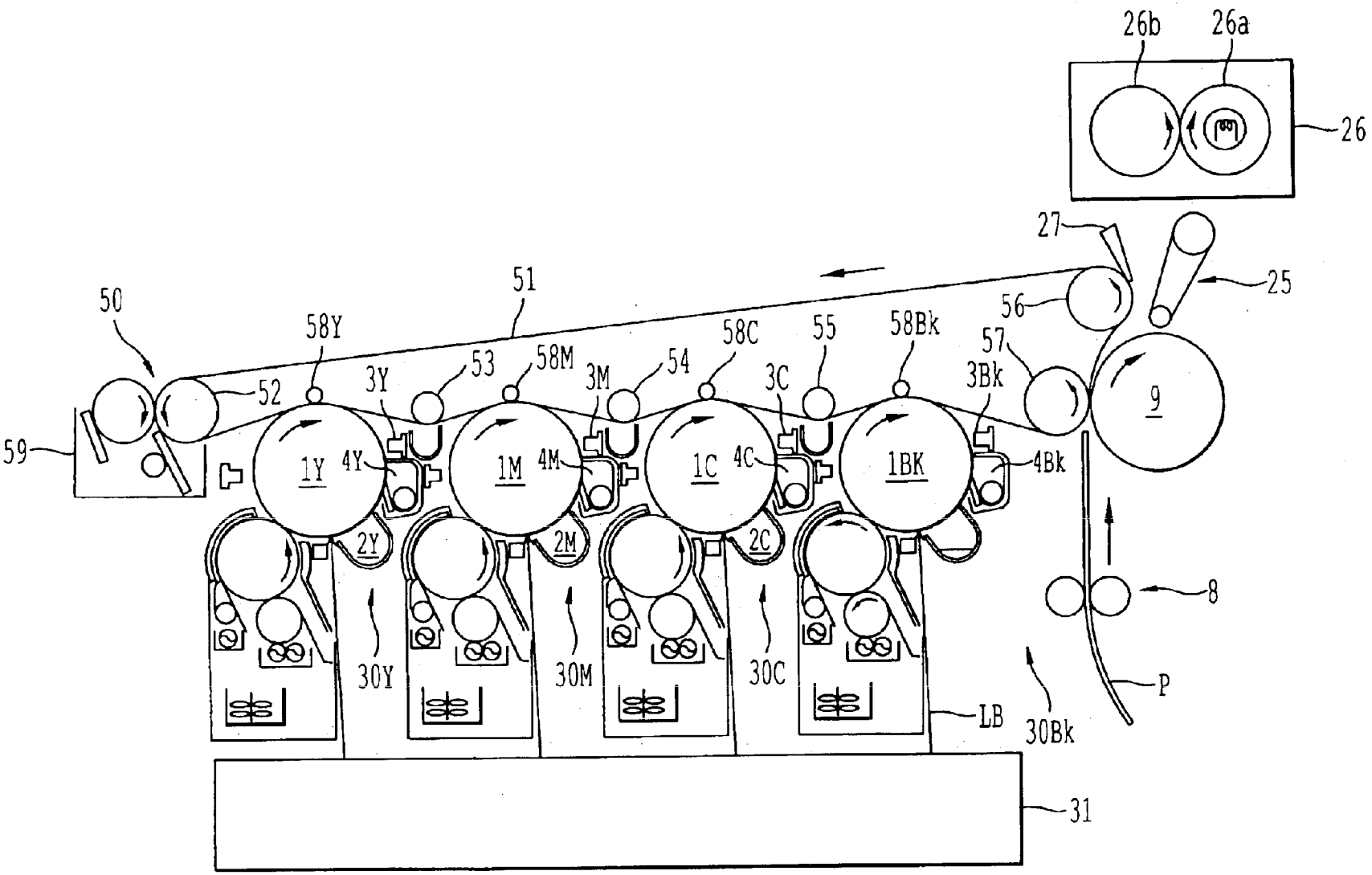
FIG. 15 is a schematic configuration diagram of an apparatus of a modified example which adopts a full color method.

FIG. 15 is a schematic configuration diagram of an apparatus of a modified example which adopts a full color method, to which the present invention is applied. This apparatus of the modified example comprises four process units 30Y, 30M, 30C and 30BK, an optical writing unit 31 which irradiates a laser beam LB thereto, and an intermediate transfer roller 50.

The process units 30Y, 30M, 30C and 30BK are for forming a Y (yellow) image, an M (magenta) image, a C (cyan) image and a BK (black) image, respectively, and have substantially the same construction, except that the color of the toner in the liquid developer to be used is different. If explanation is given by taking the process unit 30BK for black image as an example, it comprises a photosensitive material drum 1BK, a drum cleaning unit 4BK, a discharging lamp 3BK, a charging unit 2BK and a developing unit 10BK. The construction of the developing unit 10BK is similar to the one shown in FIG. 3. The charging unit 2BK uniformly charges the surface of the photosensitive material drum 1BK which is rotated by a drive unit (not shown) in the clockwise direction in the figure. The surface of the photosensitive material drum 1BK uniformly charged in this manner is exposed by an exposure unit 2BK, to thereby support an electrostatic latent image for BK. This electrostatic latent image for BK is developed by the developing unit 10BK which uses the BK liquid developer to obtain a BK image. Then, the BK image is intermediately transferred onto an intermediate transfer belt 51 of an intermediate transfer unit 50. On the other hand, the drum cleaning unit 4BK removes the BK liquid developer remaining on the photosensitive material drum 1BK after having transferred the BK image. The discharging lamp 3BK discharges the residual electric charge on the photosensitive material drum 1BK after the cleaning. By this discharging, the surface of the photosensitive material drum 1BK is initialized, to be prepared for the next image formation. In the other process units 30M, 30C and 30Y, an M image, C image or Y image is formed in the same manner on the photosensitive material drum, and intermediately transferred onto the intermediate transfer belt 51, and sequentially overlapped.

The intermediate transfer unit 50 spans the intermediate transfer belt 51 in a tensioned condition by spanning rollers 52, 53, 54, 55, 56 and 57. The intermediate transfer belt 51 is endlessly moved in the counterclockwise direction in the figure, by the spanning rollers 56 and 57 which are rotated by a drive unit (not shown). The intermediate transfer unit 50 comprises four intermediate transfer rollers 58Y, 58M, 58C and 58BK, and a belt cleaning unit 59. The four intermediate transfer rollers 58Y, 58M, 58C and 58BK are for intermediately transferring the image from the photosensitive material drum for Y, M, C and BK, respectively, to the intermediate transfer belt 51, and forma transfer nip for Y, M, C and BK, respectively, between the photosensitive material drum and the four intermediate transfer rollers. At each transfer nip, the intermediate transfer roller applied with an intermediate transfer bias of, for example, −300 to −500 V from a power source (not shown) abuts against the backside of the belt, to form a transfer electric field. At each transfer nip, the Y image, M image, C image and BK image mainly composed of the positively charged toner are sequentially overlapped and intermediately transferred. By this overlapped intermediate transfer, a four-color image is formed on the intermediate transfer belt 51 by overlapping four colors.

A secondary transfer bias roller 9 abuts against the belt-spanned portion between the spanning roller 56 and the spanning roller 57 at a pressure of for example 50 N/cm2, to form a secondary transfer nip. A secondary transfer bias for example of from −800 to −2000 V is applied to the secondary transfer bias roller 9 by the unillustrated power source. Thereby, a secondary transfer electric field is formed at the secondary transfer nip. The four-color image formed on the intermediate transfer belt 51 goes into the secondary transfer nip, with the endless movement of the belt. On the other hand, the transfer paper P stored in the paper feed cassette (not shown) is fed to a resist roller pair 8 at a predetermined timing. The resist roller pair 8 feeds the transfer paper P towards the secondary transfer nip, at a timing that can overlap the transfer paper P on the four-color image on the intermediate transfer belt 51. Therefore, at the secondary transfer nip, the four-color image on the intermediate transfer belt 51 is brought into close contact with the transfer paper P. Then, by the influence of the secondary transfer electric field, the positive toner is attracted towards the transfer paper P, and the four-color image is secondarily transferred onto the transfer paper P. The four-color image is transferred onto a white transfer paper P to form a full color image. The residual toner after transfer which remains on the intermediate transfer belt 51 after the secondary transfer is cleaned by the belt cleaning unit 59.

The transfer paper P having passed through the secondary transfer nip is separated from the intermediate transfer belt 51 by a separation claw 27, and then fed into a fixing unit 26 by a paper carrier belt unit 25. Then, the transfer paper P passes through a fixation nip formed by a heating roller 26*a* and a pressurizing roller 26*b* in the fixing unit 26 to thereby fix the full color image, and is then ejected outside of the apparatus.

Four toner bottles which store Y, M, C and BK liquid developers and a carrier bottle which stores a liquid developer are arranged in the apparatus body. The liquid developer and the nonconductive liquid are appropriately replenished from these bottles to the developing units 10Y, 10M, 10C and 10BK. The Y, M, C and BK liquid developers are produced by the ball mill or three rolls, respectively disclosed in Japanese Patent Application Laid-Open No. HEI 3-198084 A, Japanese Patent Application Laid-Open No. HEI 3-200264 A, Japanese Patent Application Laid-Open No. HEI 3-225356 A, and Japanese Patent Application Laid-Open No. HEI 3-291671 A. In the apparatus of this modified example, the liquid developer containing a toner of a density of from 15 to 20% in a nonconductive liquid having a viscosity of from 100 to 1000 mPa·s is used.

The present inventors made six kinds of test machines listed below for trial purposes:

(1) one in which the attriter in FIG. 4 is applied to the printer in FIG. 3, (2) one in which the attriter in FIG. 13 is applied to the printer in FIG. 3, (3) one in which the attriter in FIG. 4 is applied to the printer in FIG. 14, (4) one in which the attriter in FIG. 13 is applied to the printer in FIG. 14, (5) one in which the attriter in FIG. 4 is applied to the printer in FIG. 15, and (6) one in which the attriter in FIG. 13 is applied to the printer in FIG. 15.

In either test machine, a decrease in the toner charge quantity with the lapse of time could be suppressed, without crushing the toner. However, if the attriter was not used, a decrease in the toner charge quantity with the lapse of time was recognized.

As the image formation apparatus to which the present invention is applied, the apparatus of a modified example employing a charge quantity calculation method may be used. This apparatus of a modified example employing a charge quantity calculation method obtains the toner charge quantity, which is the information of changes in the charge quantity, not based on the detection result of the charge quantity detection unit, but by calculation. Specifically, a characteristic equation showing a change with the lapse of time of the toner charge quantity in the liquid developer in which the toner is not replaced is studied by a preliminary test, and is stored as operational equation 1. Further, a relational equation between the developer replenishment time by a toner replenishment pump which is a replenishment unit, the operation time of the developing unit and cumulative image area, and a change in the toner charge quantity by means of the toner replacement is studied by a preliminary test. Then, this relational equation is stored in the control mechanism as operational equation 2. Also, the dispersion suspension time which is the time when the redispersion mechanism such as the attriter is not operated, the developer replenishment time and the operation time of the developing unit are measured by the control mechanism, being a timing unit, as a continuous suspension time. The cumulative image area is also calculated by the control mechanism. Then, a change of the toner charge quantity with the lapse of time, when it is assumed that the toner is not replaced, is calculated based on the continuous suspension time and the operational equation 1. This change with the lapse of time is corrected based on the measured developer replenishment time and operation time of the developing unit, the calculation result of the cumulative image area, and an amount of change in the toner charge quantity by means of the toner replacement, which is calculated based on the operational equation 2. Thereby, the toner charge quantity can be obtained.

The present invention is also applicable to a developing unit which is not an image formation apparatus, but a liquid development apparatus. In this case, not only the electric characteristics evaluation mechanism 16 but also a high voltage generation apparatus and an amperometric device are provided in the developing unit, to thereby transmit the measurement result of the current value to the control mechanism of the image formation apparatus. That is, the electric characteristics evaluation mechanism 16, the high voltage generation apparatus and the amperometric device excluding the control mechanism constitute a charge quantity detection unit. In this manner, it is possible to make the control mechanism of the image formation apparatus control the redispersion mechanism such as the attriter based on the toner charge quantity.

In the printer in this embodiment, the charge quantity detection unit is provided, so that the control mechanism can obtain the toner charge quantity based on the detection result thereof. According to such construction, more accurate toner charge quantity can be obtained than the apparatus of the modified example employing the charge quantity calculation method. As a result, crushing of the toner due to excessive stress loading in the attriter can be reliably suppressed.

In the apparatus of the modified example employing the charge quantity calculation method, the toner charge quantity can be obtained by calculation. Hence, it can be avoided that the apparatus construction becomes complicated due to having the charge quantity detection unit attached thereto, or a cost increase can be avoided.

In the printer in this embodiment or apparatus of various modification examples, the nonconductive liquid having a viscosity of from 0.5 to 1000 mPa·s, a boiling point of not lower than 100° C., an electrical resistance of at least $1\times10^{12}$ Ωcm, and a surface tension of not larger than 30 dyne/cm is used. Thereby, stains or disorder of the image resulting from the residual nonconductive liquid on the paper can be suppressed. In addition, the difficulty of handling because the nonconductive liquid is designated as a hazardous substance can be dissolved. Problems such that the storage method of the liquid developer becomes difficult due to excellent volatility of the nonconductive liquid, the apparatus construction becomes complicated due to the sealed structure of the printer body, the cost increases, and the printer installation environment is limited, can be also dissolved. It can be dissolved that the development becomes impossible due to a current leak between toners. Deterioration in the image quality due to adhesion of a toner mass caused by poor wettability of the toner can be also suppressed.

In the printer in this embodiment or in the apparatus of each modification example, since the peripheral speed of the agitator 23*c*, being the stress application member, is 1.0 m/sec, these include a condition that the stress application member is made to collide with the liquid developer at a speed of at least 1.0 m/sec. With such a construction, the chemically non-equilibrium state can be reliably generated in the liquid developer, to reliably suppress a change in the toner charge quantity with the lapse of time.

In the printer in this embodiment, silicone oil is used as a nonconductive liquid to be contained in the liquid developer. Thereby, pollution due to the volatilization of the nonconductive liquid or fixation thereof inside the attriter can be prevented, thereby enabling improvement in manufacturing the liquid development apparatus or in the work environment at the time of use. Further, by preventing the fixation, the construction inside of the attriter can be simplified, to thereby drop the frequency of maintenance work.

From the explanation, according to the present invention, there is the excellent effect that the toner charge quantity in the liquid developer can be made more stable, while dissolving a problem in that the apparatus construction becomes complicated due to the attachment of a charge control agent replenishment mechanism.

The present document incorporates by reference the entire contents of Japanese priority documents, 2001-161749 filed in Japan on May 30, 2001 and 2002-111104 filed in Japan on Apr. 12, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A liquid development apparatus comprising:

a developer storage section which stores a liquid developer containing a toner in the liquid;

a stress application unit which applies stress loading to the liquid developer in the developer storage section; and a charge quantity detection unit which detects the toner charge quantity of the liquid developer in the developer storage section, wherein the stress application unit is operated according to toner charge quantity change information.

2. A liquid development apparatus according to claim 1, wherein the stress application unit is a disperser.

3. A liquid development apparatus comprising:

a developer storage section which stores a liquid developer containing a toner in the liquid;

a stress application unit which applies stress loading to the liquid developer in the developer storage section; and a charge quantity detection unit which detects the toner charge quantity of the liquid developer in the developer storage section, wherein the stress application unit is an attriter.

4. A liquid development apparatus comprising:

a developer storage section which stores a liquid developer containing a toner in the liquid;

a stress application unit which applies stress loading to the liquid developer in the developer storage section; and a charge quantity detection unit which detects the toner charge quantity of the liquid developer in the developer storage section, wherein the stress application unit is a ball mill, a beads mill or a sand mill.

5. A liquid development apparatus comprising:

a developer storage section which stores a liquid developer containing a toner in the liquid;

a stress application unit which applies stress loading to the liquid developer in the developer storage section; and a charge quantity detection unit which detects the toner charge quantity of the liquid developer in the developer storage section, wherein the charge quantity detection unit comprises a micrometer, a light voltage generation apparatus and a computer.

6. An image formation apparatus comprising:

a liquid development apparatus having a developer storage section which stores a liquid developer containing a toner in the liquid, and a stress application unit which applies stress loading to the liquid developer in the developer storage section; and a control unit which controls at least the liquid development apparatus, wherein the control unit controls the operation of the stress application unit, based on the charge quantity change information showing the change in the toner charge quantity of the liquid developer in the developer storage section.

7. The image formation apparatus according to claim 6, wherein the liquid development apparatus comprises a charge quantity detection unit which detects the charge quantity of the toner in the liquid developer in the developer storage section, and the control unit obtains the charge quantity change information based on the detection result thereof.

8. The image formation apparatus according to claim 6, further comprising:

a replenishment unit which replenishes a new liquid developer or toner to the developer storage section;

a timing unit which times the replenishment time by the replenishment unit, the operation time of the liquid development apparatus and the suspension time of the stress application unit; and an image area ratio calculation unit which calculates the cumulative image area ratio of the formed image, wherein the control unit obtains the charge quantity change information based on the timing result by the timing unit and the calculation result of the image area ratio calculation unit.

9. The image formation apparatus according to claim 6, wherein the liquid developer has a viscosity of the liquid of from 0.5 to 1000 mP·s, an electrical resistance of at least $1\times10^{12}$ Ωcm, a surface tension of not larger than 30 dyne/cm, and a boiling point of not lower than 100° C.

10. The image formation apparatus according to claim 6, wherein the stress application unit applies a stress by making a stress application member collide with the liquid developer at a speed of at least 1.0 m/sec.

11. The image formation apparatus according to claim 6, wherein the liquid developer uses silicone oil as the liquid.

12. The image formation apparatus according to claim 6, wherein a liquid developer containing a charge control agent is used as the liquid developer.

13. A method for developing an electrostatic latent image comprising the steps of:

storing in a developer storage section a liquid developer containing a toner in the liquid;

applying stress loading to the liquid developer in the developer storage section using a stress application unit; and detecting a toner charge quantity of the liquid developer in the developer storage section, wherein the stress application unit is operated according to toner charge quantity change information.

14. The method according to claim 13, wherein the stress application unit is an attriter.

15. The method according to claim 13, wherein the stress application unit is a disperser.

16. The method according to claim 13, wherein the stress application unit is a ball mill, a beads mill or a sand mill.

17. The method according claim 13, wherein the step of detecting a toner charge quantity is performed using a micrometer, a light voltage generation apparatus and a computer.

* * * * *